United States Patent [19]

Klitsner et al.

[11] Patent Number: 5,073,138

[45] Date of Patent: Dec. 17, 1991

[54] MODULAR GEAR AND FRAME TOY

[75] Inventors: Daniel B. Klitsner, San Francisco; D'Miles E. Milsal, Sunol, both of Calif.

[73] Assignee: Discovery Toys, Inc., Martinez, Calif.

[21] Appl. No.: 546,293

[22] Filed: Jun. 29, 1990

[51] Int. Cl.[5] ..... A63H 33/08; A63H 33/12

[52] U.S. Cl. ..... 446/103; 446/105

[58] Field of Search ..... 446/103, 102, 104, 105, 446/106, 107, 111, 116, 120, 121, 122, 125, 227, 85, 86

[56] References Cited

U.S. PATENT DOCUMENTS

| | | | |
|---|---|---|---|
| 2,313,357 | 3/1943 | Pajeau | 446/106 |
| 3,193,293 | 7/1965 | Schaper | 446/103 X |
| 3,461,601 | 8/1969 | Kristiansen | 446/103 |
| 4,485,930 | 12/1984 | Savelkouls | 446/125 X |
| 4,547,160 | 10/1985 | Labelle | 446/103 X |
| 4,690,656 | 9/1987 | Friedman et al. | 446/95 |
| 4,813,903 | 3/1989 | Furukawa et al. | 446/104 X |
| 4,826,464 | 5/1989 | Bertrand | 446/122 X |
| 4,950,197 | 8/1990 | Dove et al. . | |

FOREIGN PATENT DOCUMENTS

| | | | |
|---|---|---|---|
| 0104716 | 4/1984 | European Pat. Off. | 446/103 |
| 2425896 | 12/1975 | Fed. Rep. of Germany | 446/103 |
| 3802738 | 8/1989 | Fed. Rep. of Germany | 446/85 |

*Primary Examiner*—Robert A. Hafer
*Assistant Examiner*—D. Neal Muir
*Attorney, Agent, or Firm*—Townsend and Townsend

[57] ABSTRACT

A modular toy (1) allowing easy assembly for children has a frame (3), a bridge (23), and a hub assembly (27) as primary features. The frame and bridge have slots (5, 6), which in turn have fasteners (7). The hub assembly snaps or otherwise removably mounts in the slots. This allows toy pieces, such as gears (57, 59), to be placed on the hub assemblies. The gears can be rotated on the hubs and effect movement of other gears attached to other hubs. The slots are generally equally spaced so that children have an easy method of effecting the movement.

22 Claims, 7 Drawing Sheets

MODULAR GEAR AND FRAME TOY

BACKGROUND OF THE INVENTION

This invention relates generally to toys, and specifically to toys having a plurality of construction pieces which are easily configured by children into movable figures.

In typical children's toys which may be constructed from various pieces, individual pieces may be difficult for a child or one of similar mental capabilities to physically put pieces together in order that one piece may effect movement of another piece on a structure. It would be advantageous if a child or one of similar mentality could have as his or her only limitation in constructing a toy only his or her imagination, and not the necessity of trying to place parts of the toy at different locations in order to effect movement. It would further be advantageous if a toy could be devised comprising easily formulated pieces, for example by injection molding common plastics.

SUMMARY OF THE INVENTION

In accordance with the above objectives, the toy as described herein has a modular spacing of slots in a frame, allowing easy alignment for young to older age group children. In one embodiment, gears attach to hubs, and the hubs snap in place into a frame. The hubs are easily fitted and removed from slots in the frame. The hubs have a low friction bearing designed for free spinning, rotary movement of gears. Bridge pieces combine with the frame pieces to form structures. Various pieces can then work as axles on the structure, thereby allowing one gear piece to effect rotary movement of several gear pieces.

The invention comprises a modular toy allowing easy assembly for children comprising a frame having a plurality of slots, the slots having resilient fastening means on the surface, the slots spaced substantially equally apart. The modular toy further comprises a bridge having extensions able to removably connect a bridge to two or more frames so that the bridge is substantially perpendicular to the frames. Finally, there is provided a rotary movement hub assembly, which modularly and removably mounts within the resilient fastening means in the slots. The great advantage of this feature is that the modular toy may be configured with minimal effort by children in a fashion that allows rotary movement of a first part attached to the hub assembly to effect rotary movement of a plurality of parts in the same plane and at least one plane parallel to a plane of the first part.

In another embodiment, the bridge also has a plurality of bridge slots spaced with substantially the same spacing as the frame slots, the bridge slots having resilient fastening means similar to those of the frame slots. In this embodiment, the bridge pieces have extensions with resilient fastening means allowing the bridge slots to be at an angle other than 90° to horizontal. This, combined with the hub assembly, provides a method whereby the modular toy may be configured with minimal effort by children in a fashion that allows rotary movement of a first part attached to the hub assembly to effect rotary movement of a plurality of parts attached to the frame and bridge via other hubs in angles oblique to the first part.

Further improvements, advantages, embodiments and aspects of the invention will become apparent from the description which follows.

DESCRIPTION OF SPECIFIC EMBODIMENTS

Figure 1:
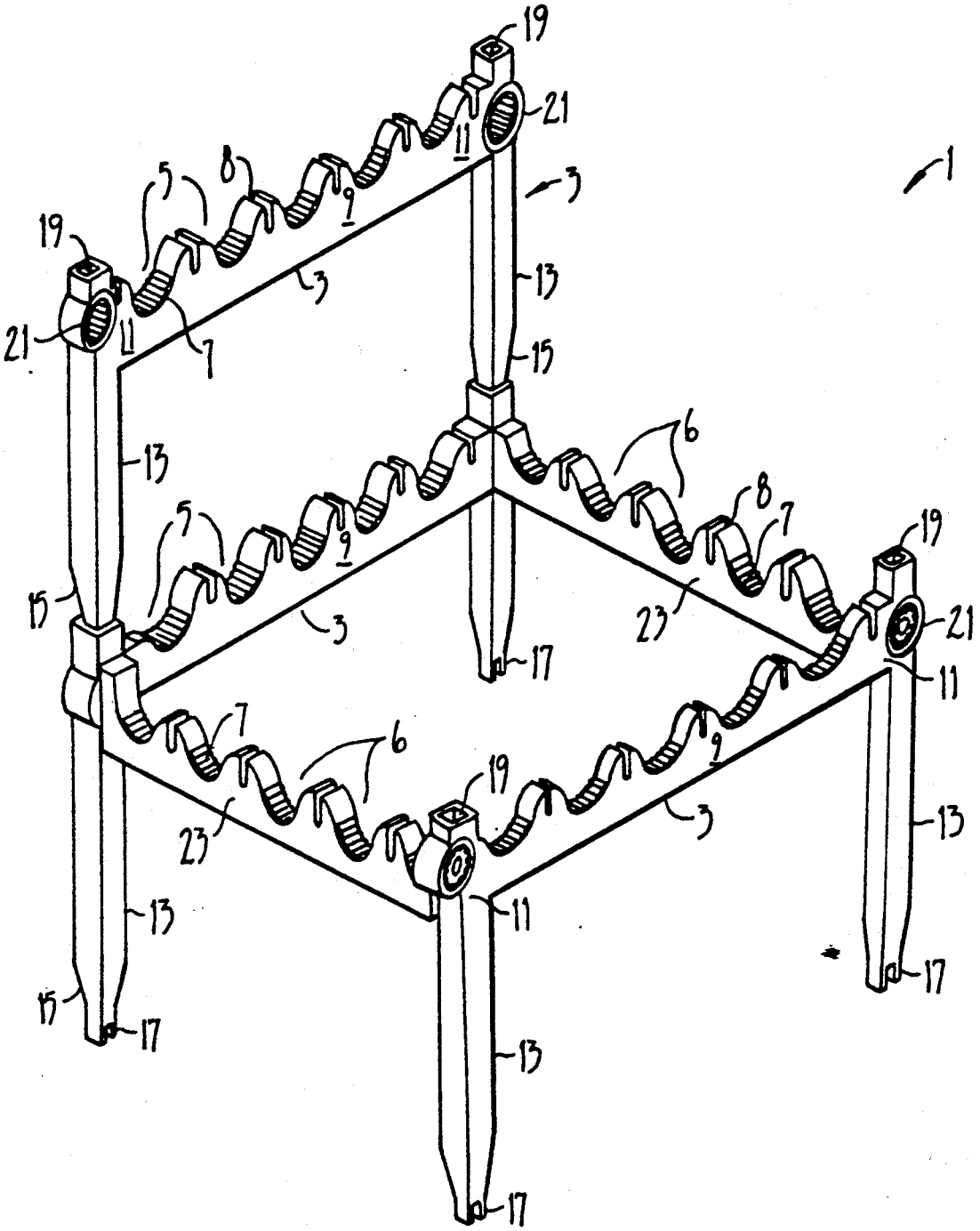
FIG. 1 is a perspective view showing bridge and frame members, both having slots with fastening means therein.

The view presented in FIG. 1 shows many of the modular toy components in assembled form. The terms "modular" and "children" are to be construed broadly. "Modular" refers to a toy which has repeating units of similar or exact shape and size, allowing children to easily construct the toy as their imaginations warrant. "Children" refers generally to young people, but also comprises mentally disadvantaged people or indeed "older" adults who seek a carefree means of entertainment. The assembled modular toy 1 includes a frame 3 having frame slots 5, and resilient fastening ridges 7 on the inside surface of said slots. Frame 3 has cross-beams 9, said cross-beams having ends 11. Frame 3 also has support legs 13 having tapered ends 15, and male members 17 adapted to be inserted into female receptacles 19 on frame 3. Frame 3 further has annuli 21 at the ends of frame 3. Annuli 21 are adapted to receive bridge pieces 23. Bridge pieces 23 have bridge extensions 25 (shown in FIG. 2).

Figure 2:
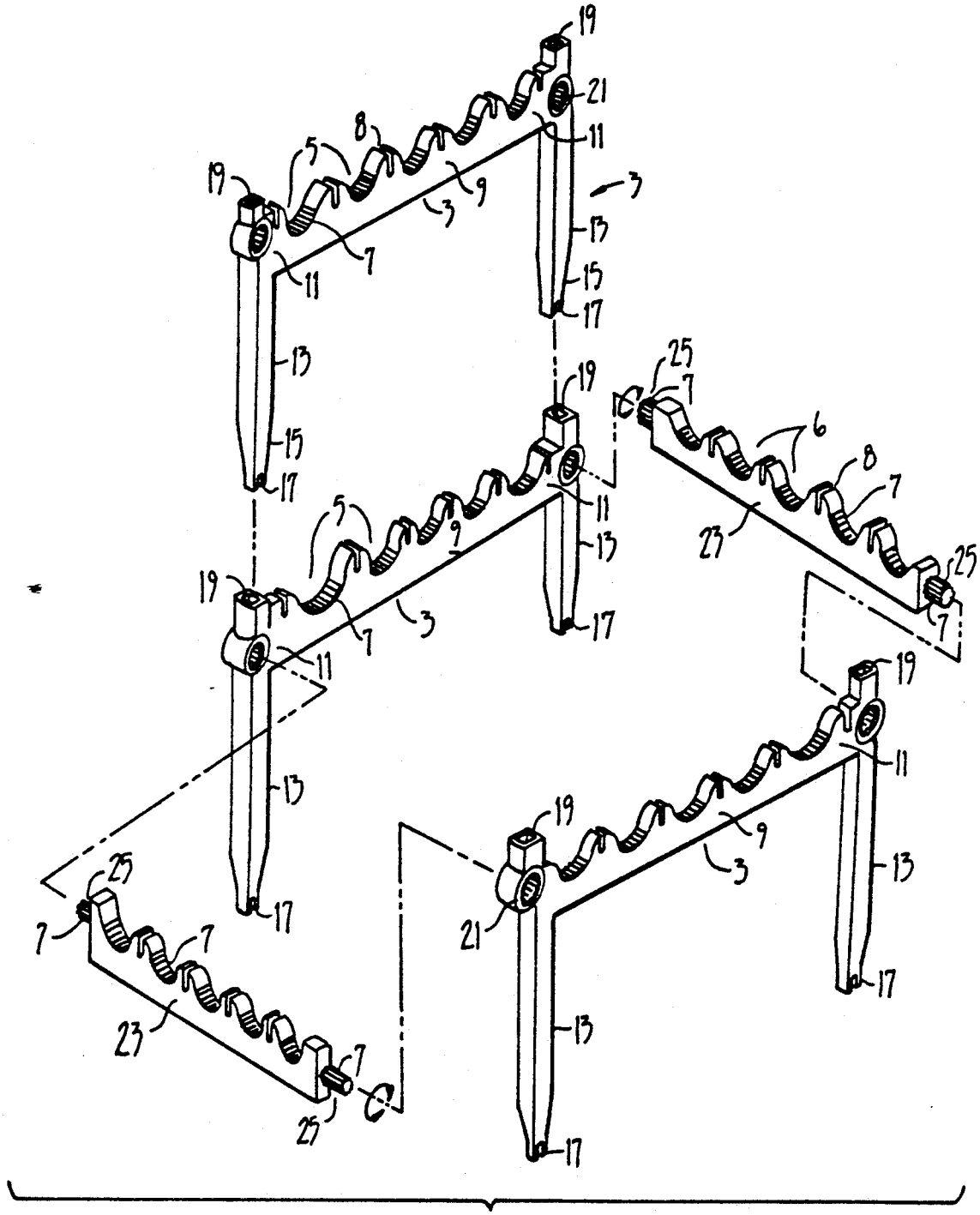
FIG. 2 is an exploded perspective view showing the individual pieces of FIG. 1.

FIG. 2 shows an exploded perspective view of the frame and bridge pieces, showing individual bridge pieces 23 having bridge extensions 25, the extensions having resilient fastening ridges 7 thereon. Bridge extensions 25 fit into annuli 21 on frames 3. Frame slots 5 and bridge slots 6 also have resilient fastening ridges 7 into which bridge extensions 25 may be inserted. Therefore, in this embodiment of the invention, bridge 23 may either fit into annuli 21 or slots 5, and have slots 6 either at the same angle to horizontal as frame slots 5 or at an oblique angle to horizontal. This particular configuration allows rotary movement of a first part attached to a hub assembly (described herein) to effect rotary movement of a plurality of parts attached to the frame and the bridge. The frame slots 5 and bridge slots 6 are equally spaced apart, allowing easy attachment of parts in a orderly fashion.

Figure 3:
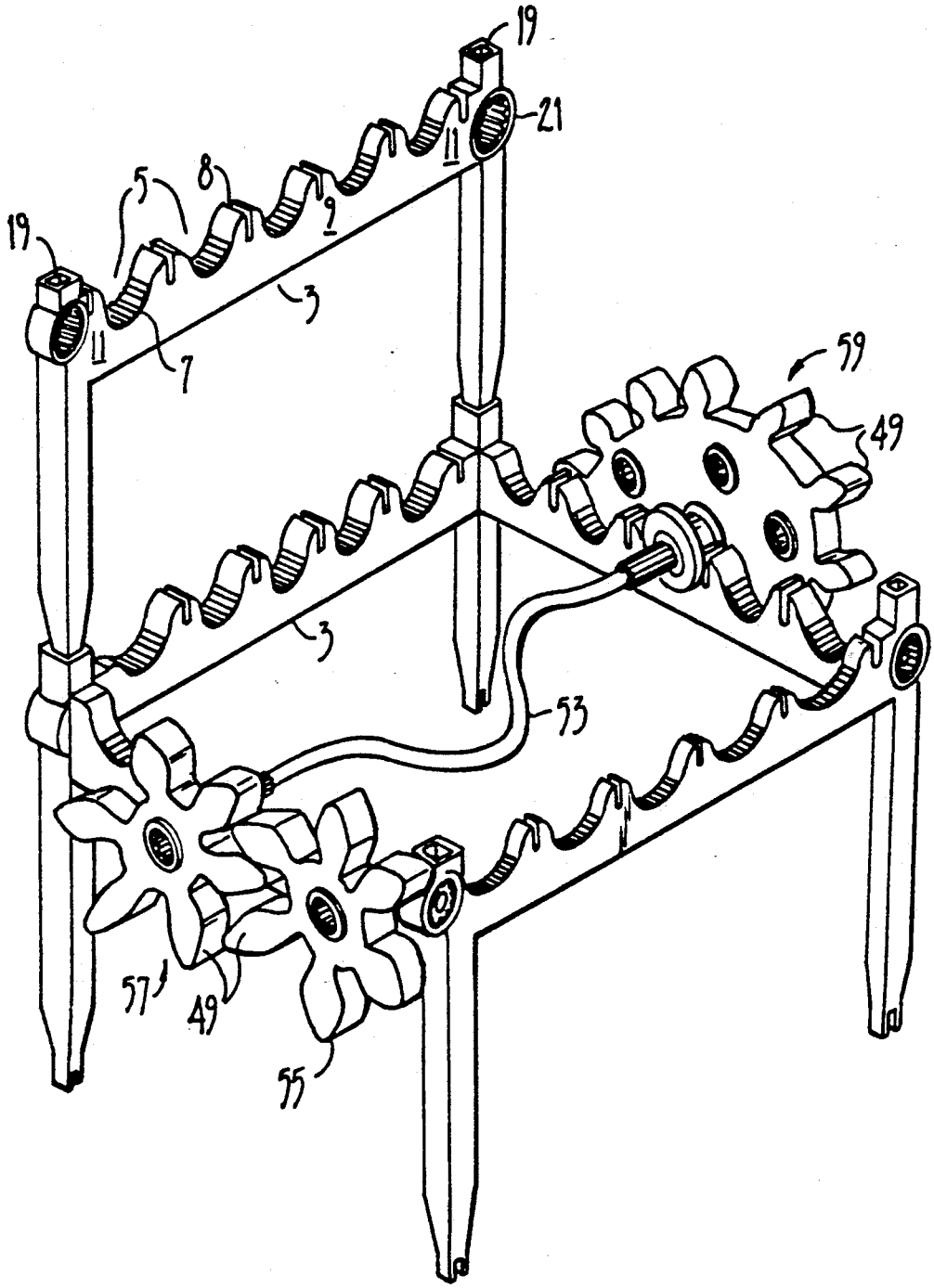
FIG. 3 is a perspective view showing three gears, two of the gears connected via an axle.

FIG. 3 shows a frame and bridge construction similar to that in FIG. 1, further showing gears 55, 57, and 59 attached to the modular toy. The gears have interlocking teeth 49, so that gears lying in different planes can be moved by moving a gear in one plane by virtue of toy piece 53, in this case an axle. It will be generally known to those skilled in the art that other configurations of the gears and toy pieces 53 will work just as well. For example, toy piece 53 may simply be a straight axle. As can be seen in FIG. 3, rotation of gear 55 in a clockwise manner will effect rotation of gear 57 in a counterclockwise rotation. Since gear 57 is connected via toy piece 53 to gear 59, gear 59 will also turn in a counterclockwise manner, and so on through a plurality of gears. The only limit to this movement would be a child's imagination in constructing the toy. In the embodiment shown in FIG. 3, gear 55 must be placed in the "first" slot, since gear 57 is in the "third" or middle slot. Putting gear 55 into the "second" slot is not possible.

Figure 4:
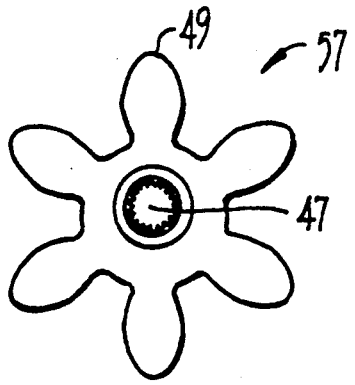
FIG. 4 is a side elevation of a gear.
Figure 5:
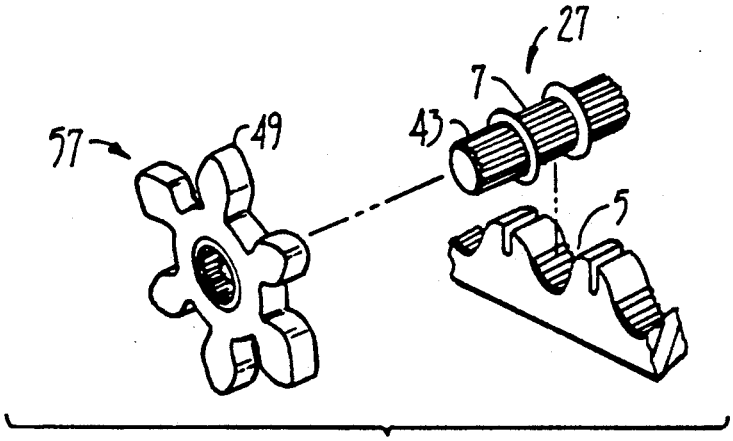
FIG. 5 shows a perspective view of a bridge or frame slot, a hub assembly, and a gear and how the pieces connect together.
Figure 6:
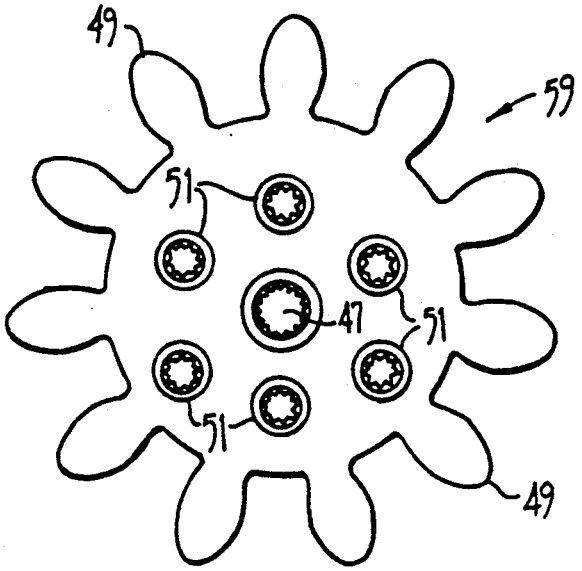
FIG. 6 is another gear, showing both central and noncentral attachment areas.

FIGS. 4, 5 and 6 show gears and how they attach to a hub assembly 27. Hub assembly 27 has resilient fastening ridges 7 which slip into resilient fastening ridges on frame slots 5 (it being recognized that this could also be a bridge slot). Hub assembly 27 has a hub shaft 33, onto which a gear such as 57 may slip onto. FIG. 4 shows one embodiment of a gear that could be used in this invention, having teeth 49. The gear has a central area 47 for attaching to a hub assembly 27 or other toy pieces. FIG. 6 shows another embodiment of a gear, showing central area 47 and non-central areas 51 to which varied toy pieces may be attached to the structure.

Figure 7:
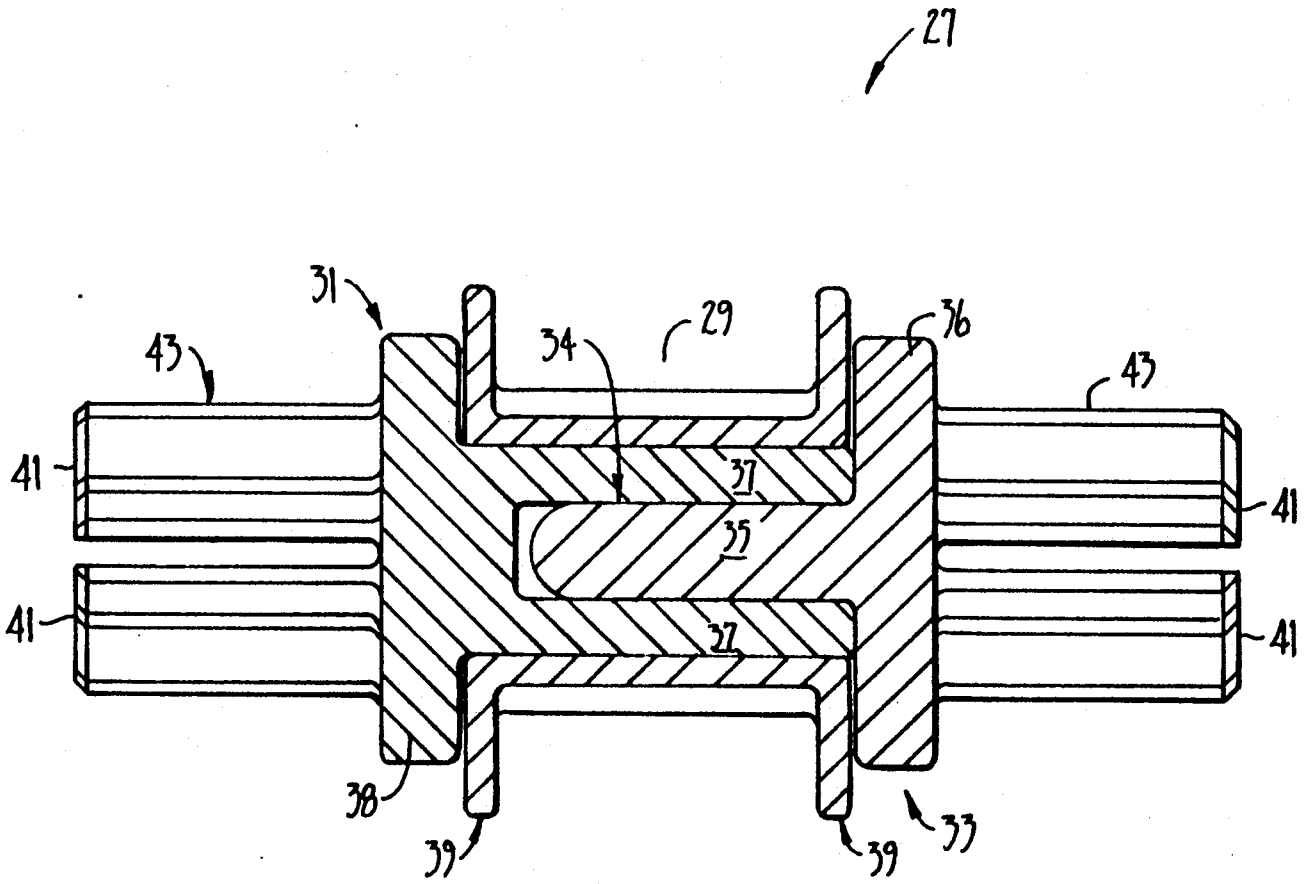
FIG. 7 is a side sectional view of a hub assembly according to one embodiment of the invention.

An important aspect of the modular toy of the present invention is shown in FIG. 7, the hub assembly 27. FIG. 7 shows a hub assembly 27 in its constructed form, showing hub spool 29, hub housing 31, and hub shaft 33. Hub shaft 33 has a male section 35 extending into a female section 37 of the hub housing 31. Male section 35 and female section 37 are shown glued together 34 or otherwise held together. Hub shaft 33 and hub housing 31 are mounted in hub spool 29 to allow rotary movement of said hub shaft 33 and hub housing 31, while said hub spool 29 is removably mounted in slots 5. Substantial axial movement of hub shaft 33 and hub housing 31 within spool 29 is prevented by shaft flange 36 and housing flange 38. (The terms "removably mounted" and "removably connected" as used herein refer to pieces which may be easily placed and temporarily fixed onto the modular frame toy and subsequently easily removed therefrom, i.e., not a permanent mounting or connection). Hub shaft 33 and hub housing 31 further have resilient cylindrical pins 41, having resilient fastening ridges 43 on their respective surfaces. Pins 41 are resilient in that they can bend in a cantilever beam fashion. Resilient cylindrical pins 41 may then be inserted into and held in, for example, central areas 47 of gears 57 and 59 as shown in FIGS. 4 and 6, respectively. Hub assembly 27 may then be removably mounted into frame slots 5 or bridge slots 6 in a manner shown in FIG. 5. Hub shaft 33 and hub housing 31, after being suitably connected, are rotatably mounted in hub spool 29. As used herein, the term "rotatably mounted" refers to a mounting which allows the hub housing and hub shaft to rotate while the spool remains fixed relative to the frame, bridge, hub housing and hub shaft.

Figure 8C:
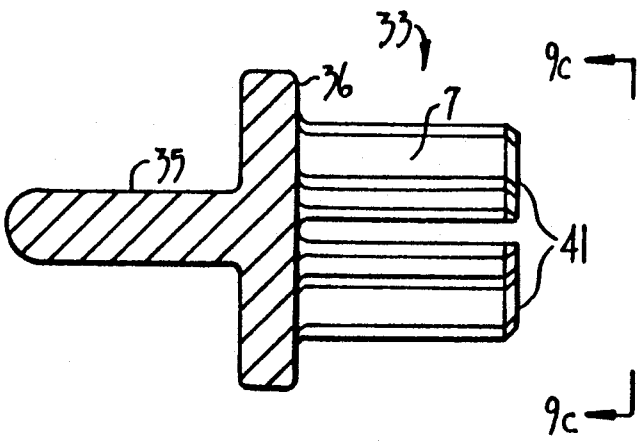
FIGS. 8A–8C represent an exploded sectional view of a hub assembly, showing a hub spool, hub housing, and hub shaft.
Figure 8B:
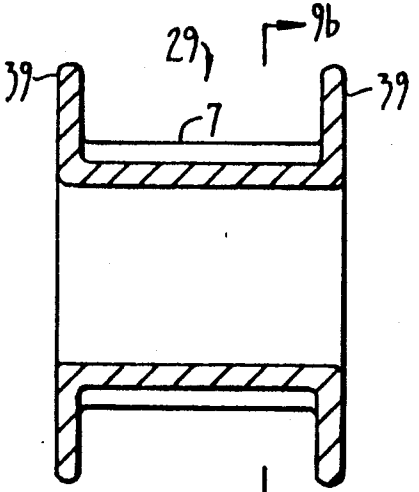
Figure 8A:
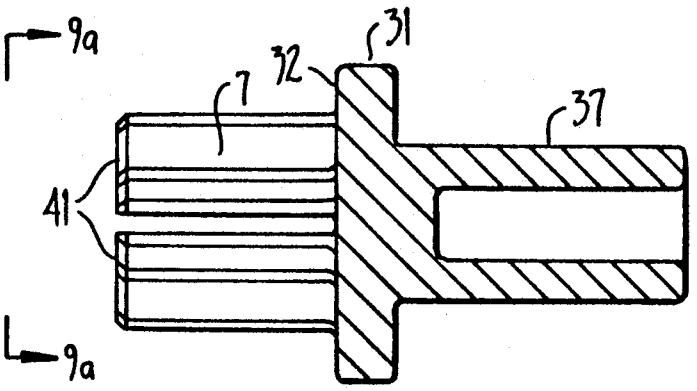

FIGS. 8A–C show the hub assembly in exploded sectional form. FIG. 8A shows the hub housing 31 with FIG. 8B showing hub spool 29 and FIG. 8C showing hub shaft 33. Spool flanges 39 are spaced from each other to just fit into slots 5 and 6 on the frames and bridges. Thus, hub assembly 27 can be removably mounted to either frame 3 or bridge 23, while gears or other pieces may be attached to resilient cylindrical pins 41 and effect rotation of other gears on the structure.

Figure 9C:
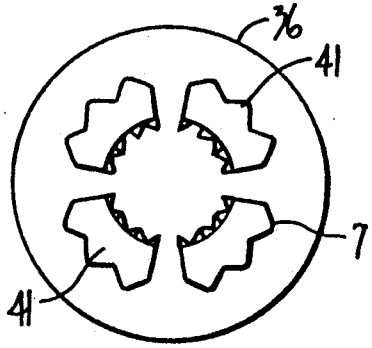
FIGS. 9A–9C are end and sectional views of the pieces shown in FIGS. 8A–8C, respectively.
Figure 9B:
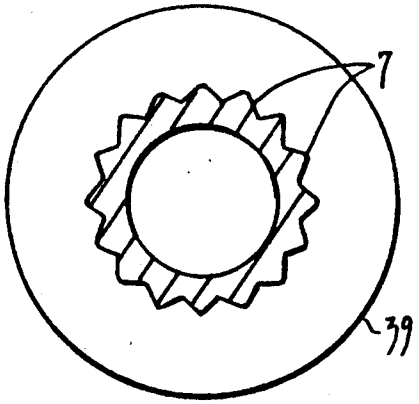
Figure 9A:
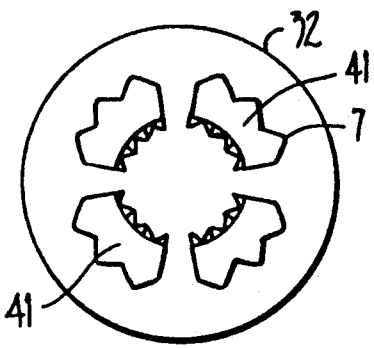

FIGS. 9A–C show an end view of the hub housing (FIG. 9A), a cross-section of the hub spool (FIG. 9B), and an end view of the hub shaft (FIG. 9C). In detail can be seen resilient fastening ridges 7 and typical angles for the ridges with respect to reference directions. Although not critical to the present invention, typical angles are about 22° 30′ between individual peaks of the fastening ridges 7. The individual ridges may be shaped in any way which will hold the pieces together. Shown in FIG. 9B is a typical angle of 90° with respect to the two sides of the ridges.

Figure 10:
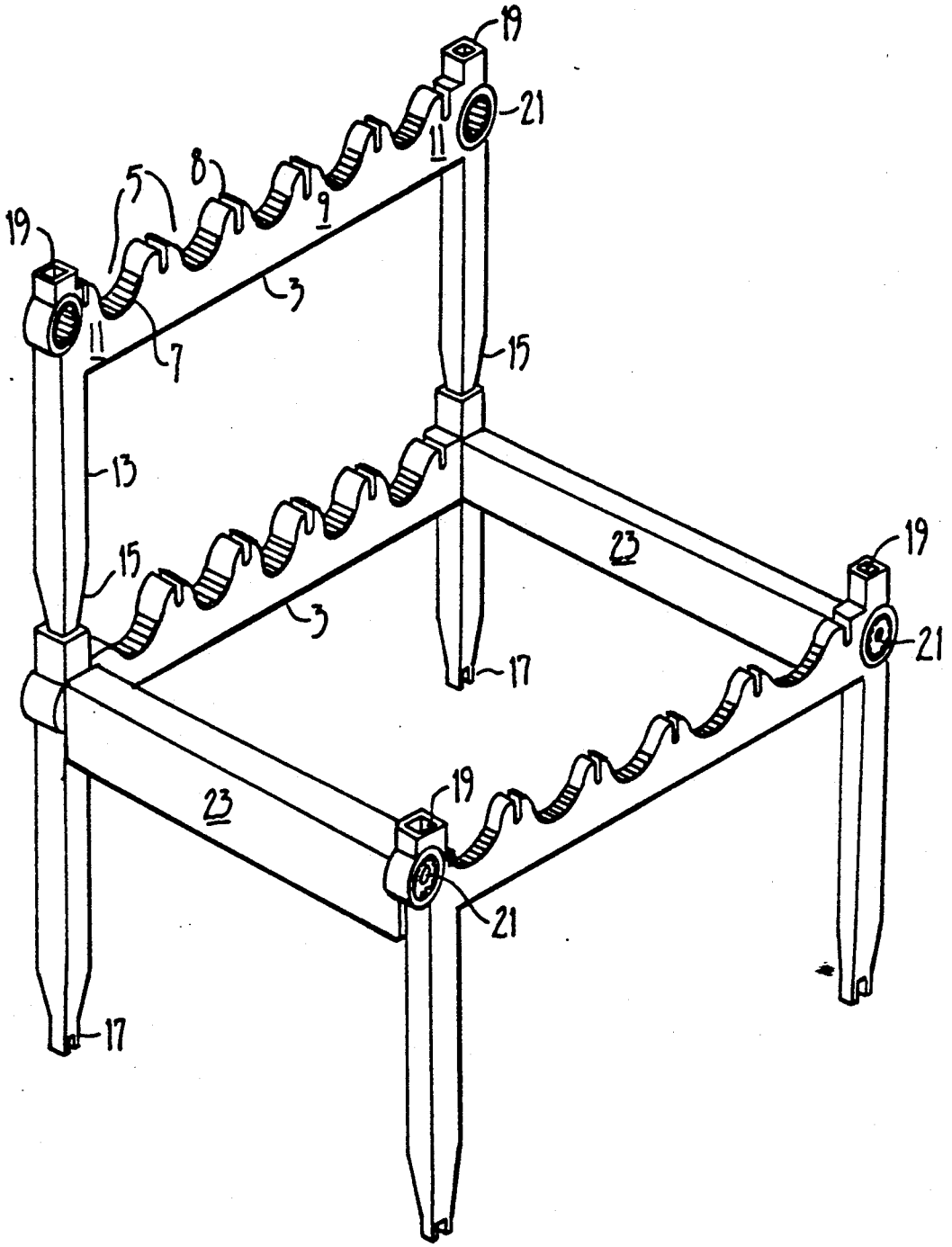
FIG. 10 is a perspective view showing a bridge having no slots, in accordance with another embodiment of the present invention.

FIG. 10 shows another embodiment of the present invention wherein the bridges 23 have no slots, and only the frame pieces have slots for holding parts such as gears and hub assemblies. In this embodiment, the modular toy comprises frame 3 having a plurality of slots 5, the slots having resilient fastening ridges 7 on their inner surfaces, the slots spaced substantially equally apart. Bridges 23 have extensions able to connect the bridges to the frame so that the bridge is substantially perpendicular to the frame. A hub assembly (not shown) can be modularly and removably mounted within the resilient fastening means in the slots, so that a modular toy may be configured with minimal effort by children in a fashion that allows rotary movement of a first part attached to the hub assembly to effect rotary movement of a plurality of parts in the same plane and at least one plane parallel to a plane of the first part. Frames 3 comprise cross-beams 9 having ends 11 and support legs 13 substantially perpendicular to the cross-beams 9. Legs 13 have tapered ends terminating in male members which are adapted to be inserted into female receptacles 19 on a second frame 3. The frames pieces 3 have annuli 21 into which extensions of bridges 23 fit. The inner surface of annuli 21 have resilient fastening ridges as described above.

Other constructions of a hub assembly can be envisioned and are considered within the scope of the appended claims. For example, a hub assembly comprising a rotor and a stator, the stator being removably mounted to the frame structure and the rotor having resilient pins able to hold toy pieces such as gears could be envisioned. The particular structural configuration is not important. What is important, however, is that the hub assembly attach to and be positioned on the frame and bridge pieces in an easy manner, such that when one hub assembly is attached to the frame or bridge piece, a second hub assembly having, for example a gear attached to it, can easily be attached by a child to effect movement of the already attached gear. The gears may either lie inside of the bridge/frame assembly, or outside, as shown in FIG. 3. In one embodiment of the invention, the gears are sized such that a large gear will fit with its hub assembly in the middle of a bridge or frame section and on the inside of the structure, so that a small or medium sized gear/hub assembly may be placed on a section of the structure perpendicular to the first gear. In this way, a large gear on the inside of the structure can turn a smaller gear placed, for example, at the second position rather than in the middle position of a bridge or frame member.

The materials of construction of the individual pieces are not critical and can be made of any material which is not toxic and will not break sufficiently easily in the hands of children, or wear through extensive use. Typical materials are acrylonitrile-butadiene-styrene (ABS) and polypropylene. Basically any material which can be easily molded to form the modular toys and fastening means can be used within the above constraints.

The resilient fastening means used to connect the individual pieces typically consist of a series of grooves or ridges which have some resilience so that the grooves of one piece may accept the ridges of another piece. The actual type of fastening means is not important, the fastening means for example could be Velcro® or any other type of fastening means which is easily taken apart.

The term "annuli" as used herein generally refers to cylindrical apertures which are complete holes through a frame member. As one skilled in the art would recognize, the annuli could merely be a depression or blind hole, that is, not an entirely void space. All that is required is that there be some way to removably fasten or mount the bridges to the frames.

The foregoing description is offered primarily for purposes of illustration. It will be readily apparent to those skilled in the art that further modifications, variations and the like may be introduced in the materials, configurations, arrangements and shapes of the various elements of the structure without departing from the spirit and scope of the invention. For example, the annuli which accept bridge extensions could be rectangular with corresponding rectangular bridge extensions.

What is claimed is:

1. A modular toy allowing easy assembly for children comprising:

a frame having a plurality of slots spaced substantially equally apart, said slots having resilient fastening means;

a bridge having extensions able to removably connect said bridge to said frame so that said bridge is substantially perpendicular to said frame;

a rotary movement hub assembly modularly and removably mounting within said resilient fastening means in said slots, so that said modular toy may be configured with minimal effort by children in a fashion that allows rotary movement of a first part attached to said hub assembly to effect rotary movement of a plurality of parts in the same plane and at least one plane parallel to a plane of the first part.

2. A modular toy in accordance within claim 1 wherein said frame comprises cross-beam members having ends and support legs substantially perpendicular to said cross-beams and said bridge, said legs attached near said ends of said cross-beam members.

3. A modular toy in accordance with claim 2 wherein said legs have tapered ends terminating in male members which are adapted to be inserted into female receptacles on a second frame.

4. A modular toy in accordance with claim 2 wherein said ends have annuli adapted to receive said extensions of said bridge.

5. A modular toy in accordance with claim 1 wherein said hub assembly comprises a stator and a rotor.

6. A modular toy in accordance with claim 5 wherein said stator comprises a hub spool and said rotor comprises a hub housing and a hub shaft, said hub housing and said hub shaft connected so that both housing and shaft are rotatably mounted in said hub spool.

7. A modular toy in accordance with claim 6 wherein said hub spool has first and second spool flanges, said flanges allowing said hub spool to be removably mounted in said slots of said frame.

8. A modular toy in accordance with claim 7 wherein said hub spool has a plurality of resilient fastening means extending longitudinally between said first and second spool flanges.

9. A modular toy in accordance with claim 7 wherein said hub housing and said hub shaft have resilient cylindrical pins extending substantially perpendicularly to said spool flanges, said resilient cylindrical pins having resilient fastening means extending longitudinally along their surface, said first part and said plurality of parts having a central area for receiving said pins and corresponding resilient fastening means in said central area, so that said first part and said plurality of parts removably mount on said pins.

10. A modular toy in accordance with claim 9 in which said first part and said plurality of parts comprise a first gear and a plurality of gears having a plurality of interlocking teeth, said teeth sufficiently rigid so that movement of said first gear can effect the movement of at least one of said plurality of gears.

11. A modular toy in accordance with claim 10 wherein said gears have resilient non-central areas for holding toy pieces.

12. A modular toy allowing easily assembly for children comprising:

a frame having a plurality of frame slots spaced substantially equally apart, said slots having resilient fastening means;

a bridge having a plurality of bridge slots spaced with substantially the same spacing as said frame slots, said bridge slots having resilient fastening means, said bridge further having extensions able to removably connect said bridge to said frame so that said bridge is substantially perpendicular to said frame, said extensions have resilient fastening means allowing said bridge slots to be at an angle other than 90° to horizontal; and a rotary movement hub assembly modularly and removably mounting within said resilient fastening means in said frame slots and said bridge slots, so that said modular toy may be configured with minimal effort by children in a fashion that allows rotary movement of a first part attached to said hub assembly to effect rotary movement of a plurality of parts attached to said frame and said bridge.

13. A modular toy in accordance with claim 12 wherein said frame comprises cross-beam members having ends and support legs substantially perpendicular to said cross-beams and said bridge, said legs attached near said ends of said cross-members.

14. A modular toy in accordance with claim 13 wherein said legs have tapered ends terminating in male members which are adapted to be inserted into female receptacles on a second frame.

15. A modular toy in accordance with claim 13 wherein said ends have annuli adapted to receive said extensions of said bridge.

16. A modular toy in accordance with claim 12 wherein said hub assembly comprises a stator and a rotor.

17. A modular toy in accordance with claim 16 wherein said stator comprises a hub spool and said rotor comprises a hub housing and a hub shaft, said hub housing and said hub shaft connected so that both housing and shaft are rotatably mounted in said hub spool.

18. A modular toy in accordance with claim 17 wherein said hub spool has first and second spool flanges, said flanges along said hub spool to be mounted in said frame slots and said bridge slots so that said spool is removably mounted to said frame or said bridge.

19. A modular toy in accordance with claim 18 wherein said hub spool has a plurality resilient fastening means extending longitudinally between said first and second spool flanges.

20. A modular toy in accordance with claim 18 wherein said hub housing and said hub shaft have resilient cylindrical pins extending substantially perpendicularly to said spool flanges, said resilient cylindrical pins having resilient fastening means extending longitudinally along their surface, said first part and said plurality of parts having a central area for receiving said pins and corresponding resilient fastening means in said central area, so that said first part and said plurality of parts removably mount on said pins.

21. A modular toy in accordance with claim 20 in which said first part and said plurality of parts comprise a first gear and a plurality of gears, said gears having a plurality of interlocking teeth, said teeth sufficiently rigid so that movement of said first gear can effect the movement of at least one of said plurality of gears.

22. A modular toy in accordance with claim 21 wherein said gears have resilient non-central areas for holding toy pieces.

* * * * *